US011633049B1

(12) United States Patent
Waggoner

(10) Patent No.: US 11,633,049 B1
(45) Date of Patent: Apr. 25, 2023

(54) USER CONFIGURABLE MATTRESS SYSTEM AND METHOD FOR CUSTOMIZING AND REPAIRING THE SAME

(71) Applicant: Justin James Waggoner, Sioux Falls, SD (US)

(72) Inventor: Justin James Waggoner, Sioux Falls, SD (US)

( * ) Notice: Subject to any disclaimer, the term of this patent is extended or adjusted under 35 U.S.C. 154(b) by 1271 days.

(21) Appl. No.: 14/918,064

(22) Filed: Oct. 20, 2015

(51) Int. Cl.

| | |
|---|---|
| ***A47C 27/15*** | (2006.01) |
| ***A47C 27/14*** | (2006.01) |
| ***A47C 27/20*** | (2006.01) |
| ***A47C 27/06*** | (2006.01) |

(52) U.S. Cl.
CPC ..... *A47C 27/15* (2013.01); *A47C 27/066* (2013.01); *A47C 27/144* (2013.01); *A47C 27/148* (2013.01); *A47C 27/20* (2013.01); *A47C 27/14* (2013.01)

(58) Field of Classification Search
CPC ..... A47C 27/15; A47C 27/148; A47C 27/14; A47C 27/142; A47C 27/144; A47C 27/20; A47C 27/066
USPC ..... 5/727, 728, 729, 739, 740, 655.9, 953
See application file for complete search history.

(56) References Cited

U.S. PATENT DOCUMENTS

| | | | | |
|---|---|---|---|---|
| 2,192,601 | A * | 3/1940 | Mattison | A47C 27/146 5/729 |
| 3,829,914 | A * | 8/1974 | Treat | A61G 7/1026 5/81.1 T |
| 5,513,402 | A * | 5/1996 | Schwartz | A47C 27/16 5/691 |
| 5,819,349 | A * | 10/1998 | Schwartz | A47C 27/148 5/740 |
| 5,953,779 | A * | 9/1999 | Schwartz | A47C 27/144 5/722 |
| 6,101,653 | A * | 8/2000 | England | A47C 27/001 5/727 |
| 6,739,008 | B1 * | 5/2004 | Kindrick | A47C 7/021 5/655.9 |
| 7,386,903 | B2 * | 6/2008 | Hochschild | A47C 27/001 5/691 |
| 8,307,482 | B2 * | 11/2012 | Gladney | A47C 27/20 5/727 |
| 9,538,855 | B2 * | 1/2017 | Gross | A47C 27/088 |
| 10,470,583 | B2 * | 11/2019 | Gross | A47C 27/088 |
| 10,531,746 | B2 * | 1/2020 | Vesey | A47C 27/06 |
| 10,905,264 | B1 * | 2/2021 | Getschow | A61G 7/0515 |

(Continued)

*Primary Examiner* — Robert G Santos

(57) ABSTRACT

A User Configurable Mattress System and Method for Customizing and Repairing the Same comprising a support cored assembly, a foam assembly, and a covering assembly. The support core assembly is preferably comprised of a high resiliency foam portion, which may include one or more layers of high resiliency foam, and preferably has a thickness between 3 and 12 inches. The foam assembly further is preferably comprised of a first layer of latex foam and a second layer of gel foam. The first layer of latex foam is positioned on top of the second layer of gel foam for users who desire a firmer mattress, the second layer of gel foam is positioned on top of the first layer of latex foam for users who desire a softer mattress. The covering assembly substantially envelopes the support core assembly and the foam assembly, and is selectively removable.

7 Claims, 4 Drawing Sheets

(56) References Cited

U.S. PATENT DOCUMENTS

| | | | | |
|---|---|---|---|---|
| 2001/0032365 | A1* | 10/2001 | Sramek | A47C 20/021 5/652 |
| 2003/0005521 | A1* | 1/2003 | Sramek | A47C 20/026 5/648 |
| 2007/0022540 | A1* | 2/2007 | Hochschild | A47C 27/15 5/727 |
| 2007/0226911 | A1* | 10/2007 | Gladney | A47C 27/20 5/691 |
| 2008/0093784 | A1* | 4/2008 | Rawls-Meehan | A47C 27/148 267/80 |
| 2010/0005595 | A1* | 1/2010 | Gladney | A47C 27/148 5/691 |
| 2011/0099722 | A1* | 5/2011 | Moret | A47C 27/15 5/701 |
| 2012/0180225 | A1* | 7/2012 | Gladney | A47C 27/20 5/740 |
| 2013/0111672 | A1* | 5/2013 | Rensink | A47C 27/15 5/698 |
| 2013/0174344 | A1* | 7/2013 | Klancnik | A47C 27/064 5/636 |
| 2014/0059776 | A1* | 3/2014 | Romero | A47C 27/15 5/655.9 |
| 2014/0208517 | A1* | 7/2014 | Gross | A47C 27/085 5/691 |
| 2017/0000265 | A1* | 1/2017 | Gross | A47C 27/15 |
| 2017/0224126 | A1* | 8/2017 | O'Connell, Jr. | A47C 27/15 |
| 2018/0008050 | A1* | 1/2018 | Vesey | A47C 27/148 |
| 2019/0038043 | A1* | 2/2019 | Fisher | A47C 27/20 |
| 2021/0186228 | A1* | 6/2021 | Martens | A47C 27/144 |
| 2022/0039560 | A1* | 2/2022 | Roma | A47C 27/144 |
| 2022/0322843 | A1* | 10/2022 | Harrison | A47C 27/15 |

* cited by examiner

USER CONFIGURABLE MATTRESS SYSTEM AND METHOD FOR CUSTOMIZING AND REPAIRING THE SAME

BACKGROUND OF THE INVENTION

Field of the Invention

The present invention relates to mattresses more particularly pertains to a new User Configurable Mattress System and Method for Customizing and Repairing the Same

Description of the Prior Art

The use of mattresses is well known in the prior art. Additionally, "Bed in a Box" type mattresses are known and have become more popular over the past few years, particularly with millennials. This type of mattress allows for the mattress to be rolled, boxed, and shipped to the consumer. Often, this type of mattress provides improved comfort over conventional spring mattresses.

The User Configurable Mattress System and Method for Customizing and Repairing the Same according to the present invention substantially departs from the conventional concepts and designs of the prior art, and in so doing provides an system which includes the benefits of conventional "Bed in a Box" type mattresses, but provides for enhanced user customization and repair.

SUMMARY OF THE INVENTION

In view of the foregoing disadvantages inherent in the known types of both conventional mattresses an "Bed in a Box" type mattresses now present in the prior art, the present invention provides a new User Configurable Mattress System and Method for Customizing and Repairing the Same which can be used in a conventional manner by the user, customized as the user's requirements change, or repaired as the bed wears over time, quickly and affordably. Additionally, because of the unique modular design and accessibility of the mattress of the present invention, the user does not need to replace the mattress as a whole, providing significant savings to the user over their lifetime.

To attain this, the present invention generally comprises a support core assembly, a foam assembly, and a covering assembly. The support core assembly is preferably comprised of a high resiliency foam portion, which may include one of more layers of high resiliency foam, and preferably has a thickness between 3 and 12 inches. The foam assembly further is preferably comprised of a first layer of latex foam and a second layer of gel foam. The first layer of latex foam is positioned on top of the second layer of gel foam for users who desire a firmer mattress, the second layer of gel foam is positioned on top of the first layer of latex foam for users who desire a softer mattress. The covering assembly substantially envelopes the support core assembly and the foam assembly, and is selectively removable.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the ability for the user to be able to simply and affordably change the basic characteristics of the mattress quickly and at a relatively low cost.

Another significant advantage of the present invention is the ability to repair the mattress as either it wears over time or the needs of the user change without having to either return the mattress to the factory or requiring the services of a skilled technician to come to the user's home.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
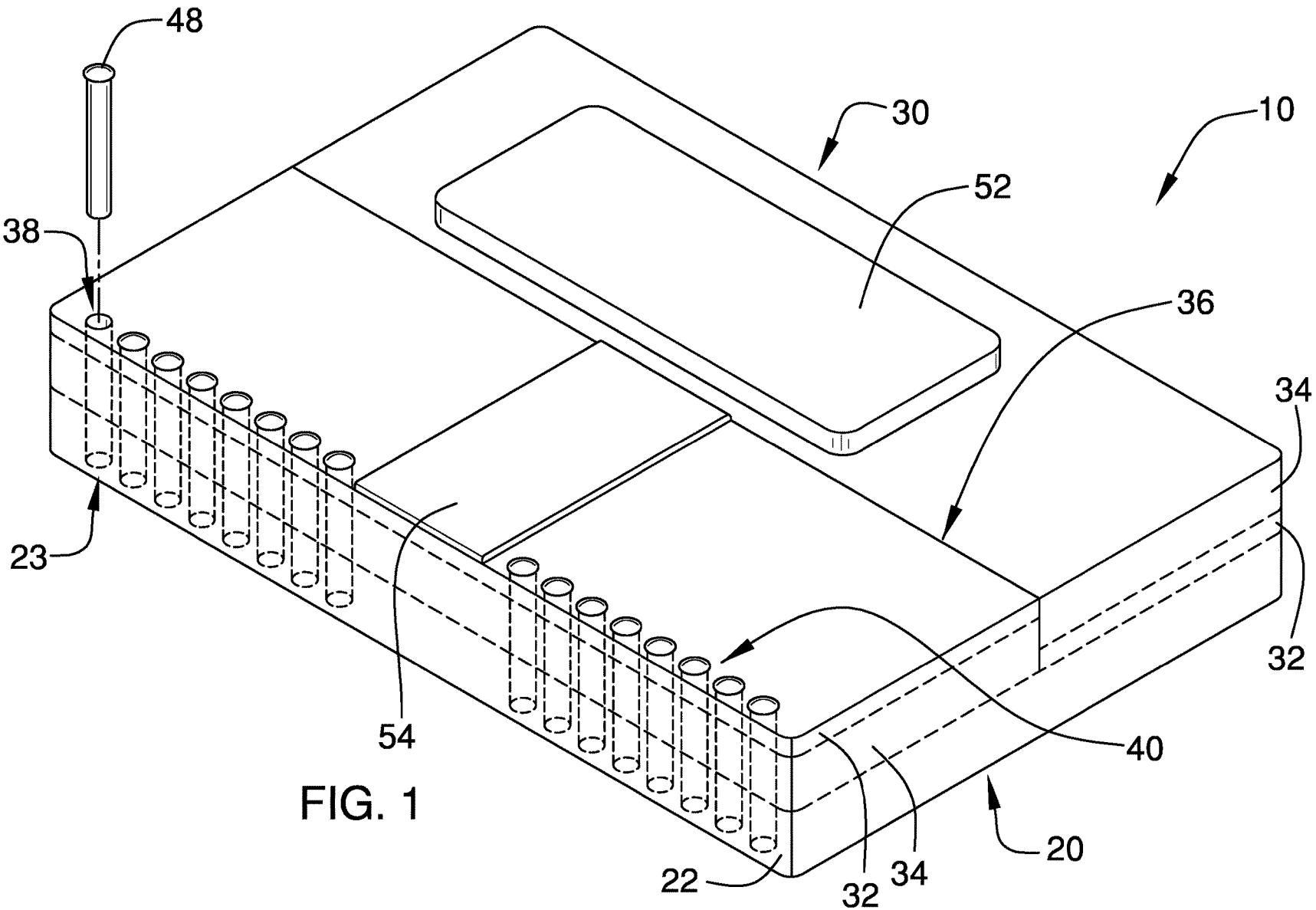
FIG. 1 is a schematic conceptual isometric view of a new user configurable mattress system according to the present invention.
Figure 2:
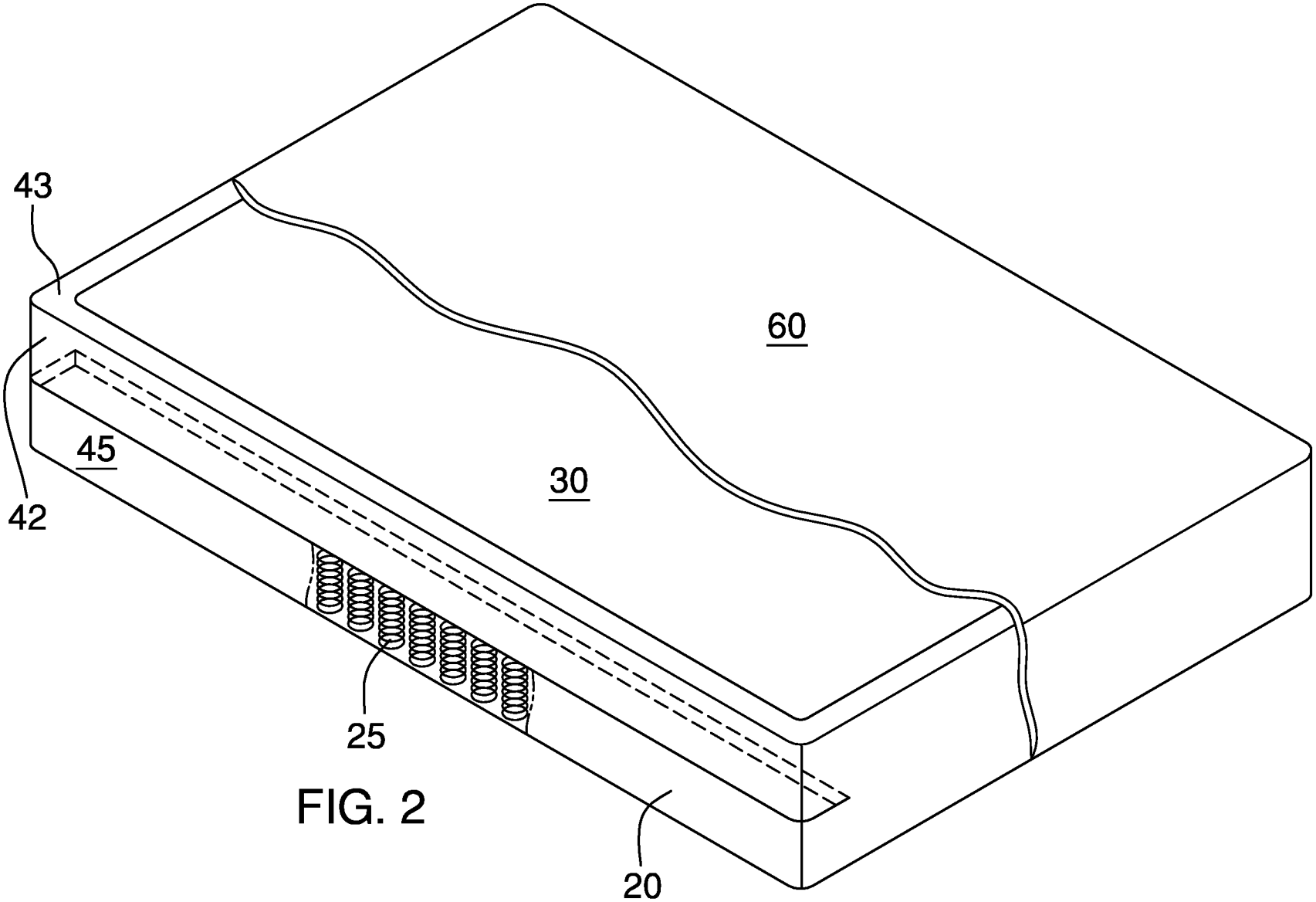
FIG. 2 is a schematic conceptual isometric view of a further embodiment of the present invention with a cutaway of the covering member and the support core assembly.
Figure 3:
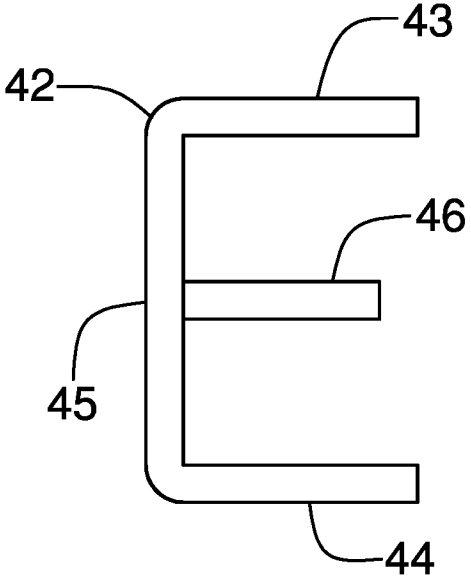
FIG. 3 is a schematic conceptual side view of the banding member present invention.
Figure 4:
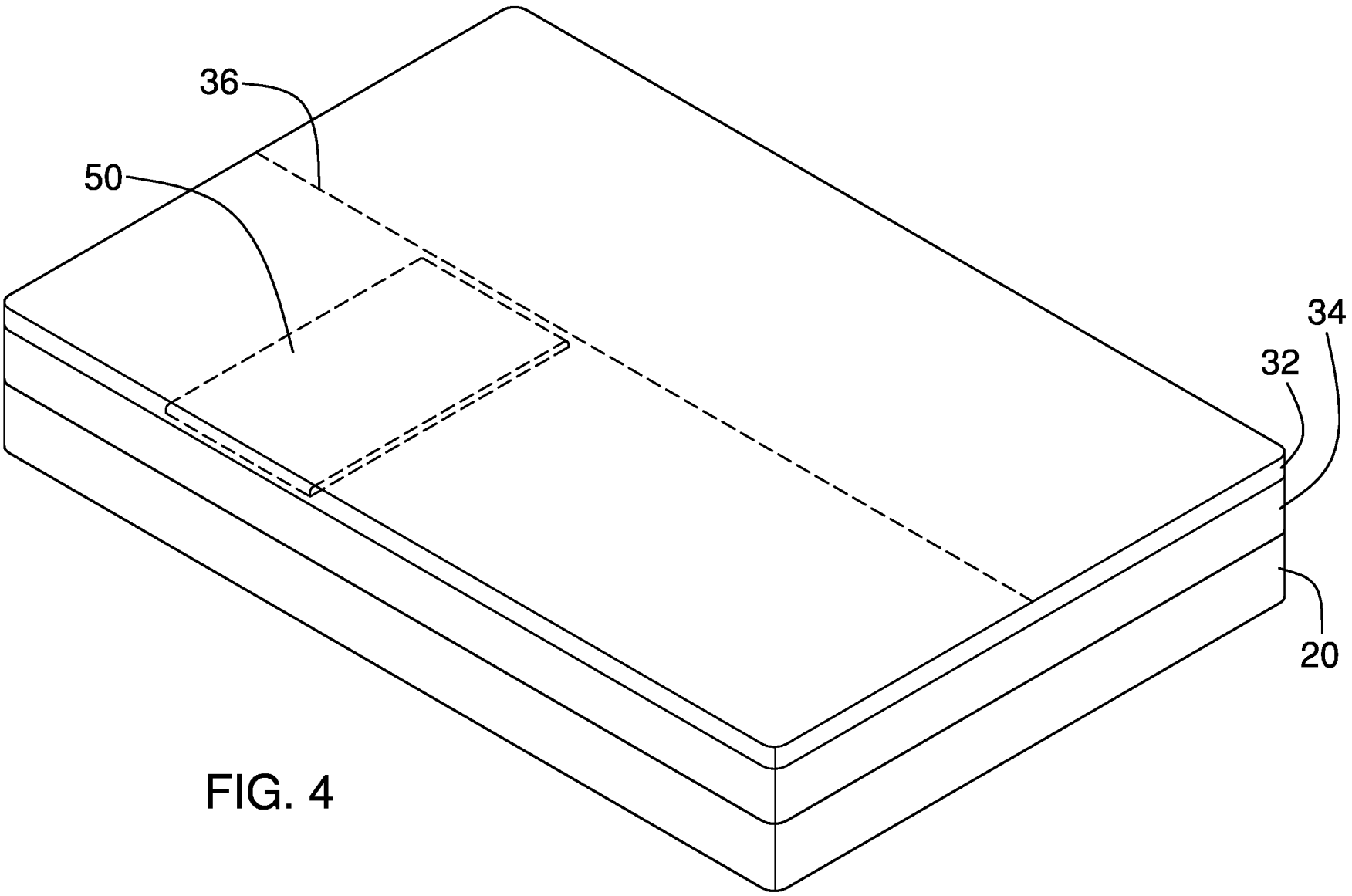
FIG. 4 is a further schematic conceptual isometric view of the present invention.

With reference now to the drawings, and in particular to FIGS. 1 through 4 thereof, a new mattress restoration assembly embodying the principles and concepts of the present invention and generally designated by the reference numeral 10 will be described.

In an embodiment, the support core assembly 20 includes a plurality of spring members 25, the plurality of spring members 25 is deployed such that a higher density of spring members are positioned towards the side edges of the support core assembly 20. This embodiment may have better applicability for the hotel, dormitory, and hospital environments, where the ability to roll the mattress for shipping is less important, and long-term durability with hard use is important.

In a preferred embodiment, the support core assembly 20 comprises a high resiliency foam portion 22. The high resiliency foam portion 22 may be made from one or more layers of high resiliency foam, the high resiliency foam portion 22 preferably has a thickness between 3 and 12 inches, with a 6 inch thickness generally being preferred for most residential applications.

In a further preferred embodiment the foam assembly 30 further comprises a first layer of latex foam 32 and a second layer of gel foam 34. The first layer of latex foam 32 has a thickness between 1 and 4 inches, and the second layer of gel foam 34 has a thickness between ½ and 3 inches. The first layer of latex foam 32 is positioned on top of the second layer of gel foam 34 for users who desire a firmer mattress. Alternately, the second layer of gel foam 34 is positioned on top of the first layer of latex foam 32 for users who desire a softer mattress. As the covering assembly 60 is removable, the user may invert these layers as they deem appropriate.

In a further embodiment, the first layer of latex foam 32 is divided into two portions with each portion running the length of the foam assembly and a portion of the width of the foam assembly. Similarly, the second layer of gel foam 34 is also divided into two portions with each running the length of the foam assembly and a portion of the width of the foam assembly. Thus, the firmness of the mattress system may be adapted for each side of the mattress separately by selecting whether the latex foam (firmer) or gel foam (softer) is on top for the user.

In still a further embodiment the first layer of latex foam includes an indicia 36 marked on at least either a top surface or a bottom surface of the first layer of latex foam 32 providing a cut-line for a user to cut the first layer of latex foam, and the second layer of gel foam 34 includes a second indicia marked on at least either a top surface or a bottom surface of the second layer of gel foam providing a second cut-line for a user to cut the second layer of gel foam. Thus, the latex foam layer 32 and the gel foam layers 34 are not individually divided unless desired by the user to provide different levels of firmness for each side of the mattress.

The system may also include one or more lumbar support member 50, which may be inserted and/or positioned by the user to provide additional lumbar support for one or both sides of the bed. The lumbar support member 50 may be positioned such that it runs laterally along a central third of at least half of the mattress. The lumbar support 50 may be made from foam, silicone, latex, polyurethane foam, gel foam, memory foam, or heat pressed fabric, depending at least in part upon the amount of support desired.

The system 10 may also include an anti-roll strip 56 which may be installed and/or positioned longitudinally along a top of the foam assembly 30 by the user to inhibit a use rolling from one side of the mattress to the other. Typically the anti-roll strip 56 is approximately 5 inches in width. The antiroll strip 56 may be tiered. The anti-roll strip 56 may be made of foam, silicone, latex, polyurethane foam, gel foam, memory foam, heat pressed fabric, or a combination thereof.

The system may also include a side support assembly 40 which may be operationally coupled to the support core assembly 20 and the foam assembly 30. The side support assembly 40 provides additional firmness along the side edges of the mattress.

In a further embodiment, the side support assembly 40 includes a banding member 42, which has a top portion 43 for abutting a top surface of the foam assembly and a bottom portion 44 for abutting a bottom surface of the support core assembly. The banding member 42 also has a side portion 45 running vertically between the top portion 43 and the bottom portion 44.

In still a further embodiment the side support assembly 40 further comprises an insert portion 46 which extends from the side portion 45 and may be positioned between the foam assembly 30 and the support core assembly 20.

In another embodiment, the side support assembly 40 does not use the banding member 42. Instead a series of apertures and plug members provide the edge support. Preferably, the foam assembly 30 has a first plurality of vertical apertures 38 extending through the foam assembly 20 with each one of the first plurality of vertical apertures is positioned adjacent to a side edge of the foam assembly. Similarly, the support core assembly 20 has a second plurality of vertical apertures 23 with each one of the second plurality of vertical apertures 23 is positioned adjacent to a side edge of the support core assembly 20. Each one of the second plurality of apertures 23 is substantially vertically aligned with a corresponding one of the first plurality of apertures 38 when the foam assembly 30 is properly aligned with the support core assembly 20. Additionally, each one of the first plurality of plug members 48 may be positioned in an associated pairing of one of the first plurality of vertical apertures 38 and one of the second plurality of vertical apertures 23. Thus, the foam assembly 30 is operationally coupled to the support core assembly 20 and the plurality of plug members 48 provide additional edge support for the mattress.

In a further embodiment, the system includes plug members 48 with different degrees of firmness, each of which may be installed or removed by a user as desired to customize the edge support for each side of the mattress, as well as along a length of each side.

The covering assembly 60 may be acrylic, rayon, polyester, a Phase Change Material Polyester core with a standard polyester sheath (PCM Poly), bamboo, cotton, wool, or similar materials. The covering assembly may have different materials from side to side, based upon user preference. Additionally the covering assembly 60 may be treated to provide a cool touch experience for the user, or may utilize a cool touch fabric such as "Cool Max", which is the registered trademark of Invista North America, 4123 East 37th Street, North Wichita, Kans. 67220 or "Outlast" which is the registered trademark of Outlast Technologies, LLC, 831 Pine Ridge Road, Golden Colo., 80403, or other similar fabrics.

It is important to note, that because of the modular nature of the mattress system, each of the components can be replaced individually. This allows for them to be customized for the user's needs, or replaced as needed without the need to buy an entire new bed.

In use, the user orders a mattress system to an original specification. The mattress is delivered to the user and initially setup by the user. As the user's need change, or as the bed wears over time, the user can determine which aspects of the bed they would like to change or replace. The user then contact the manufacturer or original seller to purchase the desired components and to receive the instructions on the preferred method for replacing and/or installing individual components for the mattress assembly.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A user configurable mattress system comprising:

a support core assembly providing primary vertical support, wherein the support core assembly further comprises a high resiliency foam portion, the high resiliency foam portion comprising one or more layers of high resiliency foam, the high resiliency foam portion having a thickness between 3 and 12 inches;

a foam assembly positioned above the support core assembly, wherein the foam assembly further comprises a first layer of latex foam and a second layer of gel foam, the first layer of latex foam having a thickness between 1 and 4 inches, the second layer of gel foam having a thickness between ½ and 3 inches, the first layer of latex foam is positioned on top of the second layer of gel foam for users who desire a firmer mattress, the second layer of gel foam is positioned on top of the first layer of latex foam for users who desire a softer mattress;

a covering assembly substantially enveloping the support core assembly and the foam assembly, the covering assembly being selectively removable; and wherein the first layer of latex foam includes an indicia marked on at least either a top surface or a bottom surface of the first layer of latex foam providing a cut-line for a user to cut the first layer of latex foam, and the second layer of gel foam includes a second indicia marked on at least either a top surface or a bottom surface of the second layer of gel foam providing a second cut-line for a user to cut the second layer of gel foam, in order to allow a user to divide individually the first layer of latex foam and the second layer of gel foam to provide different levels of firmness for each side of the mattress.

2. The user configurable mattress system of claim 1, wherein the first layer of latex foam is divided into two portions with each portion running the length of the foam assembly and a portion of the width of the foam assembly, and the second layer of gel foam is divided into two portions with each portion running the length of the foam assembly and a portion of the width of the foam assembly, whereby firmness of the mattress system may be adapted for each side of the mattress separately.

3. The user configurable mattress system of claim 1, further comprising at least one lumbar support member, the at least one lumbar support member being positionable such that it runs laterally along a central third of at least half of the mattress.

4. The user configurable mattress system of claim 1, further comprising a side support assembly, the side support assembly being operationally coupleable to the support core assembly and the foam assembly, the side support assembly providing additional firmness along the side edges of the mattress.

5. The user configurable mattress system of claim 1, further comprising:

wherein the foam assembly has a first plurality of vertical apertures therethrough, each one of the first plurality of vertical apertures being positioned adjacent to a side edge of the foam assembly;

wherein the support core assembly has a second plurality of vertical apertures, each one of the second plurality of vertical apertures being positioned adjacent to a side edge of the support core assembly, each one of the second plurality of apertures being substantially vertically aligned with a corresponding one of the first plurality of apertures when the foam assembly is properly aligned with the support core assembly;

a first plurality of plug members, each one of said first plurality of plug members being positionable in an associated pairing of one of the first plurality of vertical apertures and one of the second plurality of vertical apertures, whereby the foam assembly is operationally coupled to the support core assembly.

6. The user configurable mattress system of claim 5, wherein the first plurality of plug members provide additional edge support for the mattress.

7. The user configurable mattress system of claim 6, further comprising a second plurality of plug members, the second plurality of plug members providing a different amount of edge support for the mattress than the first plurality of plug members, each one of said first plurality of plug members and said second plurality of plug members being capable of being installed or removed by a user as desired to customize the edge support for each side of the mattress.

* * * * *